US007972106B2

(12) United States Patent
Bigi et al.

(10) Patent No.: US 7,972,106 B2
(45) Date of Patent: Jul. 5, 2011

(54) PROTECTION DEVICE FOR A TURBINE STATOR

(75) Inventors: Manuele Bigi, Calenzano (IT); Piero Iacopetti, Uzzano (IT); Riccardo Cini, Oratoio (IT)

(73) Assignee: Nuovo Pignone, S.p.A., Firenze (IT)

( * ) Notice: Subject to any disclaimer, the term of this patent is extended or adjusted under 35 U.S.C. 154(b) by 1112 days.

(21) Appl. No.: 11/575,419

(22) PCT Filed: Sep. 13, 2005

(86) PCT No.: PCT/EP2005/009886

§ 371 (c)(1),
(2), (4) Date: Mar. 16, 2007

(87) PCT Pub. No.: WO2006/029843

PCT Pub. Date: Mar. 23, 2006

(65) Prior Publication Data

US 2009/0180860 A1 Jul. 16, 2009

(30) Foreign Application Priority Data

Sep. 17, 2004 (IT) ..... MI2004A1779

(51) Int. Cl.
*F01D 25/12* (2006.01)
*F01D 9/00* (2006.01)

(52) U.S. Cl. ..... 415/115; 415/178

(58) Field of Classification Search ..... 415/114, 415/115, 116, 177, 178
See application file for complete search history.

(56) References Cited

U.S. PATENT DOCUMENTS

| | | | | |
|---|---|---|---|---|
| 3,990,807 | A * | 11/1976 | Sifford | 415/136 |
| 5,353,865 | A * | 10/1994 | Adiutori et al. | 165/133 |
| 5,598,697 | A * | 2/1997 | Ambrogi et al. | 60/782 |
| 6,402,464 | B1 | 6/2002 | Chiu et al. | |
| 6,779,597 | B2 * | 8/2004 | DeMarche et al. | 165/169 |
| 2004/0047725 | A1 * | 3/2004 | Tomita et al. | 415/116 |
| 2004/0141838 | A1 * | 7/2004 | Thompson | 415/209.3 |

FOREIGN PATENT DOCUMENTS

EP 0 709 550 A1 5/1996

* cited by examiner

*Primary Examiner* — Nathaniel Wiehe
(74) *Attorney, Agent, or Firm* — Global Patent Operation; Mark A. Conklin

(57) ABSTRACT

Protection device (10) for a stator of a gas turbine of the type comprising a series of sectors (12) constrained to each other by connection means, each sector (12) has at least one cavity (14) having a bottom (15), in correspondence with at least one cavity (14), a corresponding sheet (20) equipped with a series of pass-through holes (21) and suitable for covering at least one cavity (14) is fixed on an outer surface of the relative sector (12), each sector (12) is cooled by means of a stream of air coming from the pass-through holes (21) of the corresponding sheet (20) which is passed on the bottom (15) and discharged from at least one outlet hole, the bottom (15) of each sector (12) comprises a series of protuberances (30) to increase the thermal exchange surface and increase the cooling efficiency of the protection device (10).

12 Claims, 1 Drawing Sheet

PROTECTION DEVICE FOR A TURBINE STATOR

The present invention relates to a protection device for a turbine stator.

A gas turbine is a rotating thermal machine which converts the enthalpy of a gas into useful work, using gases coming from a combustion and which supplies mechanical power on a rotating shaft.

The turbine therefore normally comprises a compressor or turbo-compressor, inside which the air taken from the outside is brought under pressure.

Various injectors feed the fuel which is mixed with the air to form a air-fuel ignition mixture.

The axial compressor is entrained by a so-called turbine, or turbo-expander, which supplies mechanical energy to a user transforming the enthalpy of the gases combusted in the combustion chamber.

In applications for the generation of mechanical energy, the expansion jump is subdivided into two partial jumps, each of which takes place inside a turbine. The high-pressure turbine, downstream of the combustion chamber, entrains the compression. The low-pressure turbine, which collects the gases coming from the high-pressure turbine, is then connected to a user.

The turbo-expander, turbo-compressor, combustion chamber (or heater), outlet shaft, regulation system and ignition system, form the essential parts of a gas turbine plant.

As far as the functioning of a gas turbine is concerned, it is known that the fluid penetrates the compressor through a series of inlet ducts.

In these canalizations, the gas has low-pressure and low-temperature characteristics, whereas, as it passes through the compressor, the gas is compressed and its temperature increases.

It then penetrates into the combustion (or heating) chamber, where it undergoes a further significant increase in temperature.

The heat necessary for the temperature increase of the gas is supplied by the combustion of gas fuel introduced into the heating chamber, by means of injectors.

The triggering of the combustion, when the machine is activated, is obtained by means of sparking plugs.

At the outlet of the combustion chamber, the high-pressure and high-temperature gas reaches the turbine, through specific ducts, where it gives up part of the energy accumulated in the compressor and heating chamber (combustor) and then flows outside by means of the discharge channels.

In the inside of a turbine there is a stator, equipped with a series of stator blades in which a rotor, also equipped with a series of blades (rotor), is housed and is capable of rotating, said stator being rotated as a result of the gas.

The protection device, also known as "shroud", together with the platform of stator blades, defines the main gas flow.

The function of the shroud is to protect the outer cases, which are normally made of low-quality materials and therefore have a low resistance to corrosion, from oxidation and deterioration.

The shroud generally consists of a whole internal ring, or is suitably divided into a series of sectors, each of which is cooled with a stream of air coming from a compressor.

The cooling can be effected with various techniques which essentially depend on the combustion temperature and temperature decrease to be obtained.

The type of protection device to which the present invention relates comprises a series of sectors, assembled to form a ring, each of which has a cavity situated on the outer surface of each sector.

In the case of machines with a high combustion temperature, the most widely used cooling technique is that known as "impingement".

According to this technique, a sheet is fixed, preferably by means of brazing, on each cavity of each sector, said sheet equipped with a series of pass-through holes through which fresh air coming from a compressor is drawn for the cooling of the shroud itself, in particular by the impact of said air on the bottom surface of said cavity and its subsequent discharge from a series of outlet holes situated in each sector, not shown in the figures.

One of the disadvantages of current protection devices of gas turbine stators, also known as shrouds, is that the air flows through the series of holes of each sheet are not capable of efficiently cooling the relative sector as a negative interference is created between the streams themselves thus causing an inefficient cooling of the relative sector.

A further disadvantage is that the deformation which is caused as a result of the thermal stress is such as to cause clearances between the various sectors of the protection device.

These clearances in turn create the drawing of air causing a loss in efficiency of the turbine itself.

An objective of the present invention is to provide a protection device of a stator of a gas turbine, also called shroud, which allows an efficient protection of the stator.

A further objective is to provide a protection device of a stator of a gas turbine which allows a high cooling efficiency thereof.

Another objective is to provide a protection device of a stator of a gas turbine which has a greater useful life and a greater useful life of the stator itself.

An additional objective is to provide a protection device of a stator of a gas turbine which is simple and economical.

These objectives according to the present invention are achieved by providing a protection device of a stator of a gas turbine.

The characteristics and advantages of a protection device of a stator of a gas turbine according to the present invention will appear more evident from the following illustrative and non-limiting description, referring to the schematic drawings enclosed, in which.

Figure 1:
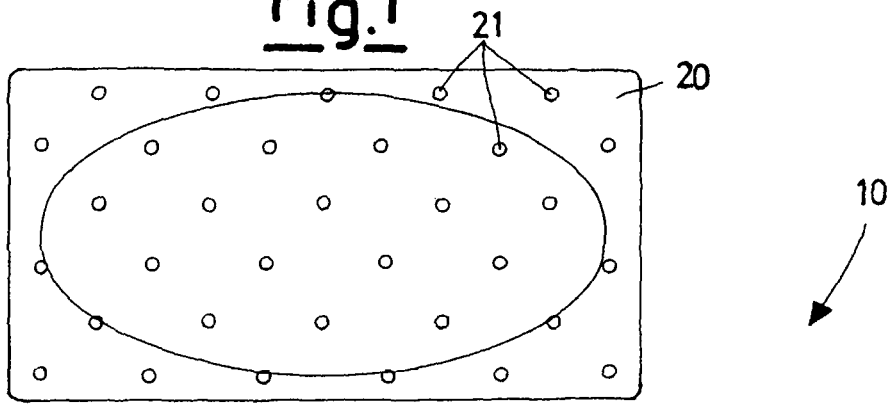
FIG. 1 is a view from above of a preferred embodiment of a sheet of a sector or a protection device of a turbine stator according to the present invention.
Figure 2:
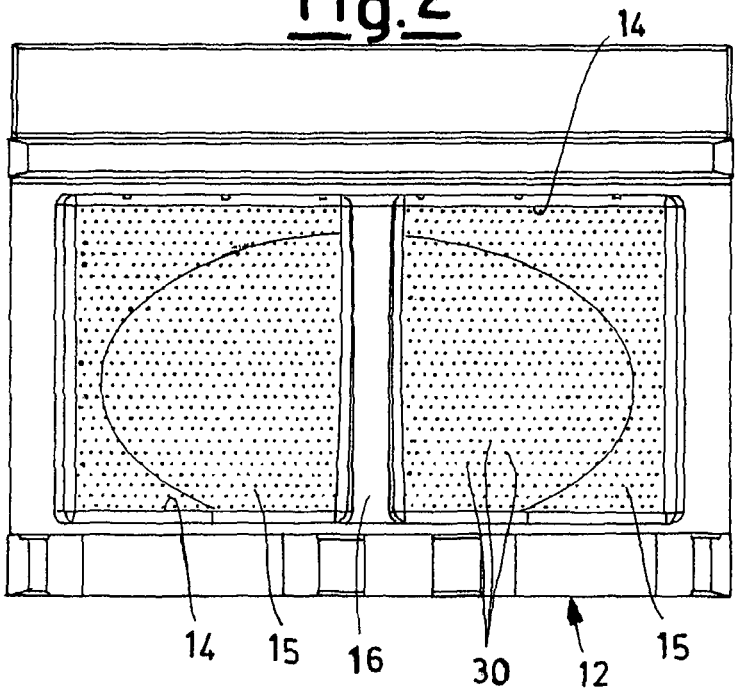
FIG. 2 is a view from above of a preferred embodiment of a sector or a protection device of a turbine stator according to the present invention.
Figure 3:
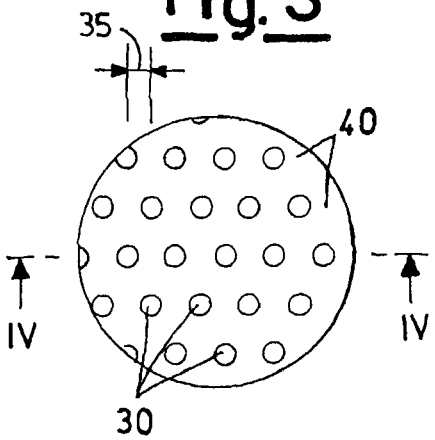
FIG. 3 is a detail of FIG. 2.

With reference to the figures, these show a protection device 10 of a stator of a gas turbine of the type comprising a series of sectors 12, each of which has at least one corresponding cavity 14 situated on its outer surface, which in turn has a bottom 15.

In correspondence with said at least one cavity 14 on the outer surface of the relative sector 12, a sheet 20 is fixed, preferably by means of brazing, which is equipped with a series of holes 21 for the passage of air for the cooling of the corresponding sector 12.

According to the present invention each sector 12 comprises a series of protuberances 30 situated in said at least one cavity 14 preferably on the bottom 15, to increase the thermal exchange surface and flow turbulence.

Said protuberances 30 can be obtained directly during the manufacturing of the sector 12, for example by melting or micromelting, or they can be subsequently obtained by means of mechanical processing operations, such as, for example, electro-erosion.

In this way, by means of said series of protuberances 30, it is possible to create a turbulent motion on the bottom of each sector 12.

In the case of high temperatures, this allows the cooling efficiency to be increased, also eliminating the negative interaction between the air flows which are drawn from the series of holes 21 of each sheet 20.

Said series of protuberances 30 is preferably uniformly distributed on the bottom 15 of the at least one cavity of each corresponding sector 12.

Furthermore, said series of protuberances 30 of each sector 12 is preferably positioned along lines 40 parallel to each other.

Figure 4:
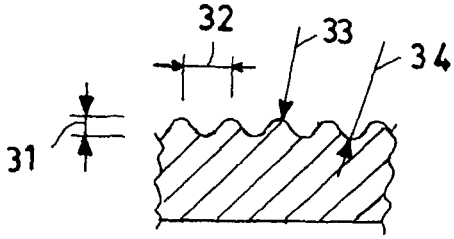
FIG. 4 is a raised sectional front view of the detail of FIG. 3 sectioned according to line IV-IV.

With reference to FIG. 4, each protuberance 30 with respect to the bottom 15 of the corresponding cavity 14, has a height 31 which, divided by the square root of the surface area of said bottom 15, has a value preferably ranging from 0.0074 to 0.0100 and even more preferably a value of 0.0087.

Along each line 40, the protuberances 30 define a surface having a series of crests and a series of hollows, each crest corresponds to the apex of each protuberance 30.

Each protuberance 30 has a crest or apex having a corresponding crest radius 33 which, divided by the square root of the surface area of said bottom 15 has a value preferably ranging from 0.0037 to 0.0050 and even more preferably a value of 0.0044.

Furthermore, each protuberance 30 is connected to the adjacent protuberances by means of a connecting radius 34 which, divided by the square root of the surface area of said bottom 15 has a value preferably ranging from 0.0037 to 0.0050 and even more preferably a value of 0.0044.

Along each line 40, the protuberances 30 are uniformly distributed and distanced at a distance 32 considered from crest to crest.

Said distance 32, divided by the square root of the surface area of said bottom 15 has a value preferably ranging from 0.0186 to 0.0251 and even more preferably a value of 0.0218.

Along an orthogonal direction to said lines 40, the protuberances 30 with respect to an adjacent line 40 are preferably translated by a distance 35.

Said distance 35, divided by the square root of the surface area of said bottom 15 has a value preferably ranging from 0.0093 to 0.0126 and even more preferably a value of 0.0109.

In order to increase its rigidity, each sector 12 is preferably equipped with a stiffening rib 16, preferably integral with the sector 12 itself and situated inside said at least one cavity 14.

It is advantageously possible, by means of a series of protuberances, to considerably limit the maximum temperature of the protection element, consequently increasing its useful life.

Furthermore, by decreasing the temperature of the component, its deformations are also advantageously limited.

In this way, it is also possible to reduce the clearances inside the turbine, consequently increasing the efficiency of the turbine itself, as the losses due to the drawing of air through the stator are reduced.

It can thus be seen that a protection device of a stator of a gas turbine according to the present invention achieves the objectives specified above.

The protection device of a stator of a gas turbine of the present invention thus conceived can undergo numerous modifications and variants, all included in the same inventive concept.

Furthermore, in practice, the materials used, as also the dimensions and components, can vary according to technical demands.

What is claimed is:

1. A protection device for a stator of a gas turbine of the type comprising a series of sectors constrained to each other by connection means, each sector has at least one cavity having a bottom, in correspondence with said at least one cavity, a corresponding sheet equipped with a series of pass-through holes and suitable for covering said at least one cavity, being fixed on an outer surface of the relative sector, each sector being cooled by means of a stream of air coming from said pass-through holes of the corresponding sheet which is passed on said bottom and discharged from at least one outlet hole, characterized in that said bottom of each sector comprises a series of protuberances to increase the thermal exchange surface and increase the cooling efficiency of the protection device, each protuberance of said series of protuberances has a crest having a crest radius which, divided by the square root of the surface area of said bottom, has a value ranging from 0.0037 to 0.0050.

2. The protection device according to claim 1, characterized in that said crest radius, divided by the square root of the surface area of said bottom, has a value of 0.0044.

3. The protection device according to claim 1, characterized in that each protuberance of said series of protuberances is connected to an adjacent protuberance by means of a connecting radius which, divided by the square root of the surface area of said bottom, has a value ranging from 0.0037 to 0.0050.

4. The protection device according to claim 3, characterized in that said connecting radius, divided by the square root of the surface area of said bottom, has a value of 0.0044.

5. The protection device according to claim 1, characterized in that each protuberance of said series of protuberances with respect to the corresponding bottom, has a height which, divided by the square root of the surface area of said bottom, has a value ranging from 0.0074 to 0.0100.

6. The protection device according to claim 5, characterized in that said height, divided by the square root of the surface area of said bottom, has a value of 0.0087.

7. The protection device according to claim 1, characterized in that said series of protuberances is positioned on the corresponding bottom along parallel lines.

8. The protection device according to claim 7, characterized in that along each line, said protuberances are uniformly distributed and distanced at a distance considered from crest to crest which, divided by the square root of the surface area of said bottom, has a value ranging from 0.0186 to 0.0251.

9. The protection device according to claim 8, characterized in that said distance, divided by the square root of the surface area of said bottom, has a value of 0.0218.

10. The protection device according to claim 7, characterized in that along an orthogonal direction to said lines, said protuberances with respect to an adjacent line, are translated by a distance which, divided by the square root of the surface area of said bottom, has a value ranging from 0.0093 to 0.0126.

11. The protection device according to claim 10, characterized in that said distance, divided by the square root of the surface area of said bottom, has a value of 0.0109.

12. The protection device according to claim 1, characterized in that each sector comprises a stiffening rib integral with the sector itself and positioned inside said at least one cavity.

* * * * *